US010605015B2

(12) United States Patent
Sipos

(10) Patent No.: US 10,605,015 B2
(45) Date of Patent: Mar. 31, 2020

(54) DUPLEX SNUBBING JACK

(71) Applicant: ODFJELL PARTNERS INVEST LTD, Aberdeen (GB)

(72) Inventor: David L. Sipos, Youngsville, LA (US)

(73) Assignee: ODFJELL PARTNERS INVEST LTD., Aberdeen (GB)

( * ) Notice: Subject to any disclaimer, the term of this patent is extended or adjusted under 35 U.S.C. 154(b) by 176 days.

(21) Appl. No.: 15/712,998

(22) Filed: Sep. 22, 2017

(65) Prior Publication Data

US 2018/0080291 A1 Mar. 22, 2018

Related U.S. Application Data

(60) Provisional application No. 62/398,370, filed on Sep. 22, 2016.

(51) Int. Cl.

| | |
|---|---|
| ***E21B 19/086*** | (2006.01) |
| ***E21B 19/08*** | (2006.01) |
| ***E21B 19/00*** | (2006.01) |
| ***E21B 19/16*** | (2006.01) |
| ***E21B 19/083*** | (2006.01) |
| ***E21B 19/24*** | (2006.01) |
| ***E21B 19/10*** | (2006.01) |
| ***E21B 33/068*** | (2006.01) |
| *E21B 33/06* | (2006.01) |

(52) U.S. Cl.

CPC ..... *E21B 19/083* (2013.01); *E21B 19/086* (2013.01); *E21B 19/10* (2013.01); *E21B 19/24* (2013.01); *E21B 33/068* (2013.01); *E21B 33/06* (2013.01)

(58) Field of Classification Search

CPC ..... E21B 19/083; E21B 19/10; E21B 19/24; E21B 19/086; E21B 19/08; E21B 19/22; E21B 19/07; E21B 19/16; E21B 19/00; E21B 33/068; E21B 33/06

USPC ..... 166/380, 383, 77.4, 85.5, 75.14, 85.1, 166/77.51, 77.53; 175/423

See application file for complete search history.

(56) References Cited

U.S. PATENT DOCUMENTS

| | | | |
|---|---|---|---|
| 3,722,603 | A | 3/1973 | Brown |
| 5,568,837 | A | 10/1996 | Funk |
| 6,386,284 | B1 | 5/2002 | Buck et al. |
| 6,412,560 | B1 | 7/2002 | Bernat |

(Continued)

OTHER PUBLICATIONS

Meadows, Marc, Analyzing Torque of Snubbing Unit, Meadows Analysis, Sep. 13, 2017.

Casing and Tubing Buckling.

*Primary Examiner* — George S Gray

(74) *Attorney, Agent, or Firm* — Roy, Kiesel, Ford, Doody & North, APLC; Brett A. North

(57) ABSTRACT

A duplex snubbing jack and method of snubbing pipe into a well bore which includes first and second gripping units that alternately and synchronously grip and release a length of pipe to be attached to a pipe string. The first and second gripping units are synchronously movable upward and downward toward and away from each other to push or pull the pipe through a BOP stack and into or out of a wellbore. Linear actuators are used to synchronously move the first and second gripping units. Guide rails are provided to laterally support the pipe as the pipe is pushed or pulled through the BOP stack into or out of the wellbore. The first and second gripping units are preferably slip-type spiders.

20 Claims, 4 Drawing Sheets

(56) References Cited

U.S. PATENT DOCUMENTS

| | | | |
|---|---|---|---|
| 6,640,939 | B2 | 11/2003 | Buck |
| 7,117,948 | B2 | 10/2006 | Mazzella et al. |
| 7,267,168 | B1 | 9/2007 | Sipos |
| 7,766,080 | B2 | 8/2010 | Khehra et al. |
| 7,775,270 | B1 | 8/2010 | Sipos |
| 9,347,282 | B1 | 5/2016 | Sipos |
| 2008/0053661 | A1 | 3/2008 | Funk |
| 2010/0224357 | A1 | 9/2010 | Rodgers |
| 2018/0030790 | A1* | 2/2018 | Still ..... E21B 19/002 |

* cited by examiner

DUPLEX SNUBBING JACK

PRIORITY

This application claims priority to U.S. provisional application Ser. No. 62/398,370 filed Sep. 22, 2016 entitled "Duplex Snubber", the entire contents of which is hereby incorporated by reference.

FIELD OF THE INVENTION

This invention relates to drilling and production of oil and gas. More specifically, the invention relates to an improved snubbing tool for use in inserting pipe or other tubing into live wells under pressure.

BACKGROUND

The wellbore pressure of an oil and as well is usually contained by pressure control equipment having resilient internal seals that seal the wellbore opening around the wellbore tubing string. Snubbing is the process of attaching a length of pipe or tubing onto the wellbore tubing string and inserting or advancing the wellbore pipe string with the newly attached length of pipe into the wellbore when the wellbore is under pressure. Snubbing often requires significant downward force on the wellbore pipe string in order to push and advance the newly attached length of pipe through the internal seals of the wellborn pressure control equipment.

Special equipment called snubbing units are used during snubbing. A typical snubbing unit has a traveling slip-type spider and that moves upward and downward between upper and lower stationary frames. The upper stationary frame serves as a work platform. The lower stationary frame supports a stationary spider used to support the wellbore pipe string at a position above the wellbore pressure control equipment. The traveling frame is attached to and supported upon the extendable and retractable piston rods of large hydraulic jacks or cylinders mounted between the lower stationary frame and the traveling frame. Extension and retraction of the piston rods of these hydraulic cylinders moves the traveling frame vertically upward and downward with respect to the lower stationary frame. This upward and downward movement allows the traveling frame and the traveling spider to be extended upward through the opening in the workbasket and downward to a position approaching the lower stationary frame and stationary pipe gripping device. The traveling frame and hydraulic cylinder combination is sometimes called a snubbing jack and the cylinders and piston rods of the duplex snubbing jack can be sized as described to produce a desired snubbing load of force.

Whey snubbing a new length pipe onto a wellbore tubing string, the wellbore tubing string is supported by the stationary spider on the stationary frame and the piston rods of the hydraulic cylinders are extended to rare the traveling frame into the opening of the workbasket. The new length of pipe is their positioned to extend vertically downward from the workbasket where it is gripped by the traveling spider of the traveling frame and held in position over the wellbore pipe string. The traveling frame with the area length of pipe is then moved downward toward the wellbore pipe string by retraction of the piston rods of the hydraulic cylinders supporting the traveling frame to a position where the new length of pipe may be threadedly connected to the wellbore pipe string by means of a top drive, rotary, tongs, or other rotating equipment. When the new length of pipe is attached to the wellbore pipe string, the wellbore pipe string is released from the stationary spider with the traveling spider gripping the new length of pipe and the attached wellbore string. The tubular piston rods of the hydraulic cylinders supporting the traveling frame are then further retracted to push or snub the new length of pipe through the internal seals of the pressure control equipment to advance the wellbore pipe string into the wellbore. This process is reversed when a pipe segment is removed from the wellbore pipe string.

Because snubbing is done under wellbore pressure, the weight of the wellbore pipe string is often less than the force generated upon the wellbore pipe string by the wellbore pressure. In such a situation, the wellbore pressure may push the wellbore pipe string upward from the wellbore. To prevent the pipe string from being ejected from the wellbore due to the wellbore pressure, the traveling and stationary frames and their associated pipe gripping devices must be positioned to maintain firm control of both the wellbore pipe string and the new length of pipe being added to the wellbore pipe string.

One problem associated with typical snubbing units is that the new length of pipe being snubbed into the wellbore is unsupported along its length when the new length of pipe is forced downward into the wellbore against the upward wellbore pressure by retraction of the piston rods of the hydraulic cylinders. The compressive forces placed on the unsupported length of pipe during snubbing increases the risk that the new length of pipe will buckle as it is pushed through the internal seals of the pressure control equipment. To reduce the risk of buckling, only relatively short lengths of tubing are inserted on each cycle of the traveling frame. This increases the time and costs associated with a typical snubbing operation.

Another problem associated with typical snubbing units is time required for the travelling spider to move from the top of the piston stroke, the position where the piston rods of the hydraulic cylinders are extended and a new length of pipe is grabbed, to the bottom of the piston stroke, the position where the new length of pipe is released after it is pushed through the internal seals of the pressure control equipment, and then return to top of the piston stroke where another length of pipe may be grabbed. The time required for the travelling spider to fully cycle downward for snubbing a new length of pipe and then upward to grip another length of pipe also increases the time associated with snubbing operations.

Consequently, there is a need for a snubbing unit jack that will provide support for the length pipe being snubbed to minimize the risk of buckling. Reducing the risk of pipe buckling will reduce the risk of damage to the wellbore pressure control equipment as well as the snubbing unit itself, will reduce the risk of injury to workers performing the snubbing operations, and will consequently reduce the risk and cost of such snubbing operations.

There is also a need for a snubbing unit jack that will minimize the time associated with performing snubbing operations. Minimizing the time associated with such snubbing operations will correspondingly reduce the overall costs associated with such operations.

SUMMARY OF THE INVENTION

Applicant proposes a duplex snubbing jack that will, among other advantages, minimize the risk of buckling a new length of pipe as it is being snubbed into a wellbore. Applicant's duplex snubbing jack will also reduce the overall time required for conducting a snubbing operation. These advantages of Applicant's snubbing jack will correspondingly reduce the cost associated with such snubbing operations.

In one embodiment Applicant's duplex snubbing jack is comprised of first or upper gripping unit and a second or lower gripping unit such as similarly configured first and second slip-type spiders. The first and second gripping units are positioned between a base frame and cap frame that are separated by a plurality of support rails. The base frame, cap frame, and the first and second gripping units each have central openings that are in co-axial alignment with each other. The base frame has a flange configuration around the central opening of the base frame that allows the duplex snubbing jack to be positioned in co-axial alignment onto or adjacent to a BOP stack or other wellhead device through which pipe may be inserted into a wellbore.

The first and second gripping units each have a pipe gripping mechanism whereby a pipe may be selectively gripped or released. One such put gripping mechanism is a plurality of gripping slips that may be moved radially inward and outward within the central opening of the first and second gripping units whereby a length of pipe may be gripped or released as desired. A mechanism for moving the gripping slips of such slip-type spiders has been described in Applicant's U.S. Pat. No. 7,775,270 entitled *Spider With Distributed Gripping Dies* and in Applicant's U.S. Pat. No. 7,267,168 entitled *Spider With Discrete Die Supports*.

A first gripping unit positioning linear actuator, or a plurality of first gripping unit positioning linear actuators, is mounted on the base frame and is attached to the first gripping unit. A second gripping unit positioning linear actuator, or a plurality of second gripping unit linear actuators, is mounted on the base frame is attached to the second pipe gripping unit. The first and second gripping unit positioning linear actuators allow the first and second gripping units to be moved co-axially with respect to each other along guide rails positioned between base frame and the cap frame. A suitable linear actuator may be a hydraulic or pneumatic cylinder having an extendable and retractable piston rod or jack rod, a rack and pinion mechanism with a motor for extending and retracting a jack rod or jack plate, or a screw jack and motor mechanism for extending and retracting a jack rod.

In operation, the base frame of the duplex snubbing jack will be mounted above the BOP stack with the first or upper gripping unit and the second or lower gripping unit situated at their outmost positions with respect to each other. In this embodiment such positioning is accomplished by extension of the jack rod of the first gripping unit positioning linear actuator and by retraction of the jack rod of the second pipe gripping unit linear actuator. When situated at their outmost position, the second or lower gripping unit is at its lowest position with respect to the BOP stack and the first or upper gripping unit situated at its extreme upward position away from the second pipe gripping unit and the BOP stack.

Retraction of the jack rod of the first gripping unit positioning linear actuator and extension of the jack rod of the second gripping unit linear actuator will synchronously move the first or upper gripping unit and the second or lower gripping unit to their inmost position with respect to each other. When situated at their inmost position, the second or lower gripping unit will have moved upwardly along the guide rails to its upmost position just below the middle of the duplex snubbing jack and the first or upper gripping unit will have moved downwardly along the guide rails to its lowest position just above the middle of the duplex snubbing jack.

In a normal operating sequence of the duplex snubbing jack, the first and second gripping units will always move synchronously toward or away from each other, never independently.

When running pipe into a wellbore, the duplex snubbing jack is positioned on the BOP stack around the axis of a wellbore pipe string. The first or upper gripping unit and the second or lower gripping units are positioned and synchronously moved to their outmost position away from each other by extension of the jack rod of the first gripping unit positioning linear actuator and by retraction of the jack rod of the second pipe gripping unit positioning linear actuator. The gripping slips of the lower gripping unit are then closed by moving the gripping slips radially inward in the central opening of the lower gripping unit to grip the wellbore pipe string while the gripping slips of the upper gripping unit are synchronously opened by moving the gripping slips of the first or upper gripping unit radially outward in the central opening of the first or upper gripping unit to allow a new length of pipe to be inserted through the central opening of the first or upper gripping unit where it may be attached to the wellbore pipe string.

When the new length of pipe is attached to the wellbore pipe string, the gripping slips of the first or upper gripping unit are closed by moving the gripping slips of the first or upper gripping unit radially inward in the central opening of the first or upper gripping unit to grip the new length of pipe now attached to the wellbore pipe string while the gripping slips of the second or lower gripping unit are synchronously opened by moving the gripping slips of the second or lower gripping unit radially outward in the central opening of the second or lower gripping unit to release the wellbore pipe string.

The first or upper gripping unit and the second or lower gripping unit are then synchronously moved downwardly and upwardly, respectively, to their inmost position toward each other by retraction of the jack rod of the first gripping unit positioning linear actuator and extension of the jack rod of the second pipe gripping unit positioning linear actuator. The downward movement of the first or upper gripping unit toward its inmost position will then run the new length of pipe through the central opening of the second or lower gripping unit and snub the new length of pipe through the BOP stack and into the wellbore.

The gripping slips of the second or lower gripping unit are then closed as previously described to grip the new length of pipe and the attached wellbore pipe string while the gripping slips of the first upper gripping unit are synchronously opened as previously described to release the wellbore pipe string. The first or upper gripping unit and the second or lower gripping unit are then synchronously moved upwardly and downwardly, respectively, to their outmost position away from each other by extension of the jack rod of the first positioning linear actuator and retraction of the jack rod of the second positioning linear actuator. The downward movement of the second or lower gripping unit will further push the wellbore pipe string into the wellbore. This process may then be repeated to snub or run additional lengths of pipe into the wellbore.

When pulling pipe from a wellbore through a BOP stack, the duplex snubbing jack is attached to the BOP stack as described above for running pipe. The first or upper gripping unit and the second or lower gripping unit are synchronously moved to their outmost position away from each other by extension of the jack rod of the first positioning linear actuator and retraction of the jack rod of the second positioning linear actuator. The gripping slips of the second or lower gripping unit are then closed b moving the gripping slips of the second or lower gripping unit radially inward in the central opening of the second or lower gripping unit to grip the wellbore pipe string the gripping slips of the first or upper gripping unit are synchronously opened by moving the gripping slips of the first or upper gripping unit radially outward in the central opening of the first or upper gripping unit to allow the first or upper gripping unit to be moved along the length of the pipe of the wellbore pipe string being pulled.

The first or upper gripping unit and the second or lower gripping unit are then synchronously moved downwardly and upwardly, respectively, to their inmost position toward each other by retraction of the jack rod of the first positioning linear actuator and extension of the jack rod of the second positioning linear actuator. The upward movement of the second or lower gripping unit toward its inmost position will then pull the wellbore pipe string through the BOP stack from the wellbore. The gripping slips of the first or upper gripping unit are then closed as previously described to grip the pipe string while the gripping slips of the second or lower gripping unit are synchronously opened as previously described to release the wellbore pipe string. The first or upper gripping unit and the second or lower gripping unit are then synchronously moved upwardly and downwardly, respectively, to their outmost position away from each other by extension of the jack rod of the first positioning linear actuator and retraction of the jack rod of the second positioning linear actuator. The upward movement of the first or upper gripping unit will further pull the wellbore pipe string from the wellbore. A length of the wellbore pipe may then be removed from the wellbore pipe string. This process may then be repeated to pull or remove additional lengths of pipe from the wellbore.

The guide rails of the duplex snubbing jack support the length of pipe being snubbed along its entire length. The lateral support of pipe being snubbed provided by the guide rails will reduce the incidence of pipe buckling as the length of pipe is pushed through the BOP stack by the reciprocal movement of the gripping units.

DESCRIPTION OF THE EMBODIMENTS

Figure 1:
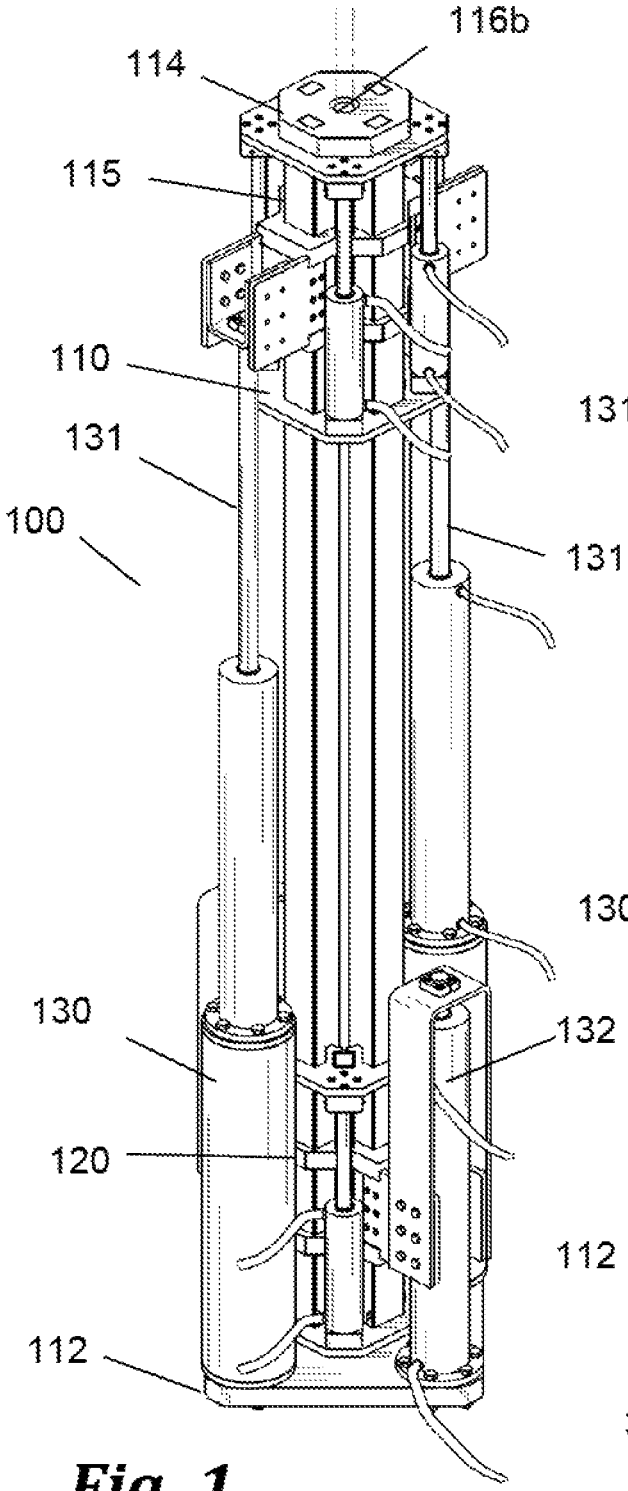
FIG. 1 is perspective view of the duplex snubbing jack described herein.

In the drawings, well established features that do not bear upon points of novelty are omitted in the interest of descriptive clarity. Such omitted features may include threaded junctures, weld lines, sealing elements, pins, and the like.

Figure 2:
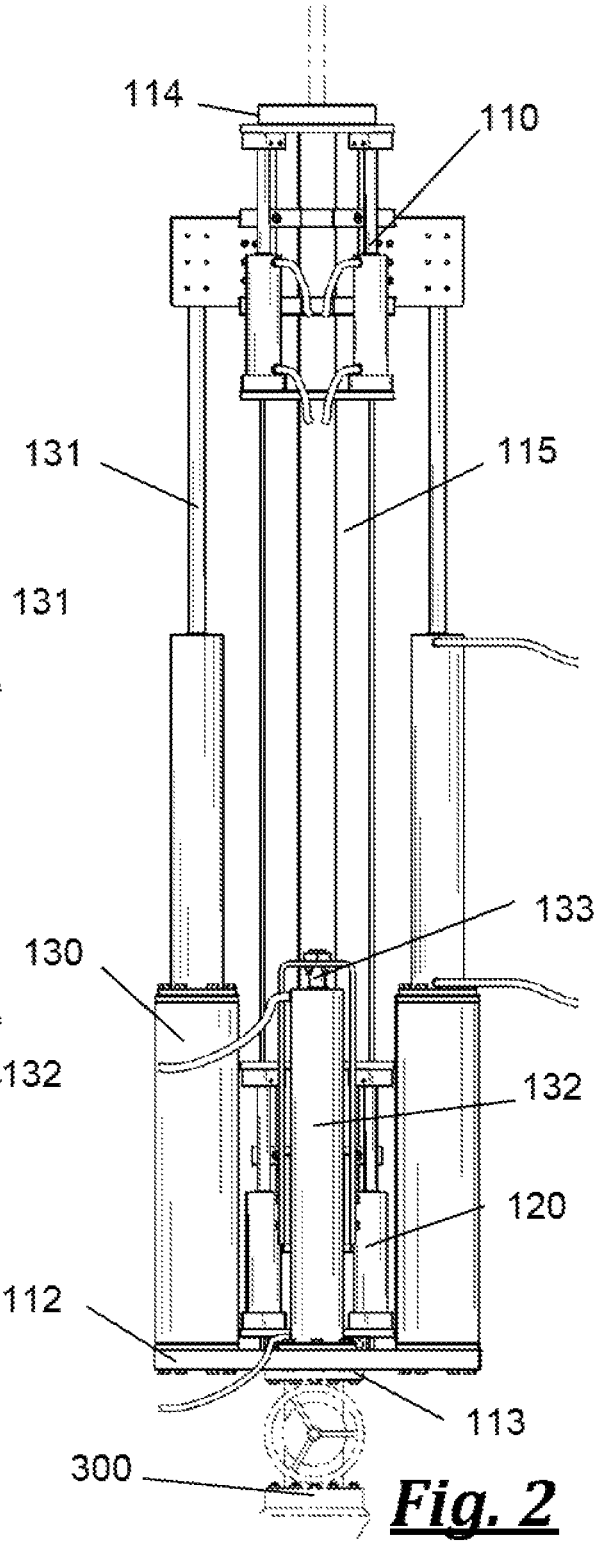
FIG. 2 is as elevation side view of the duplex snubbing jack shown in FIG. 1 with the upper and lower gripping units in their outmost position.
Figure 3:
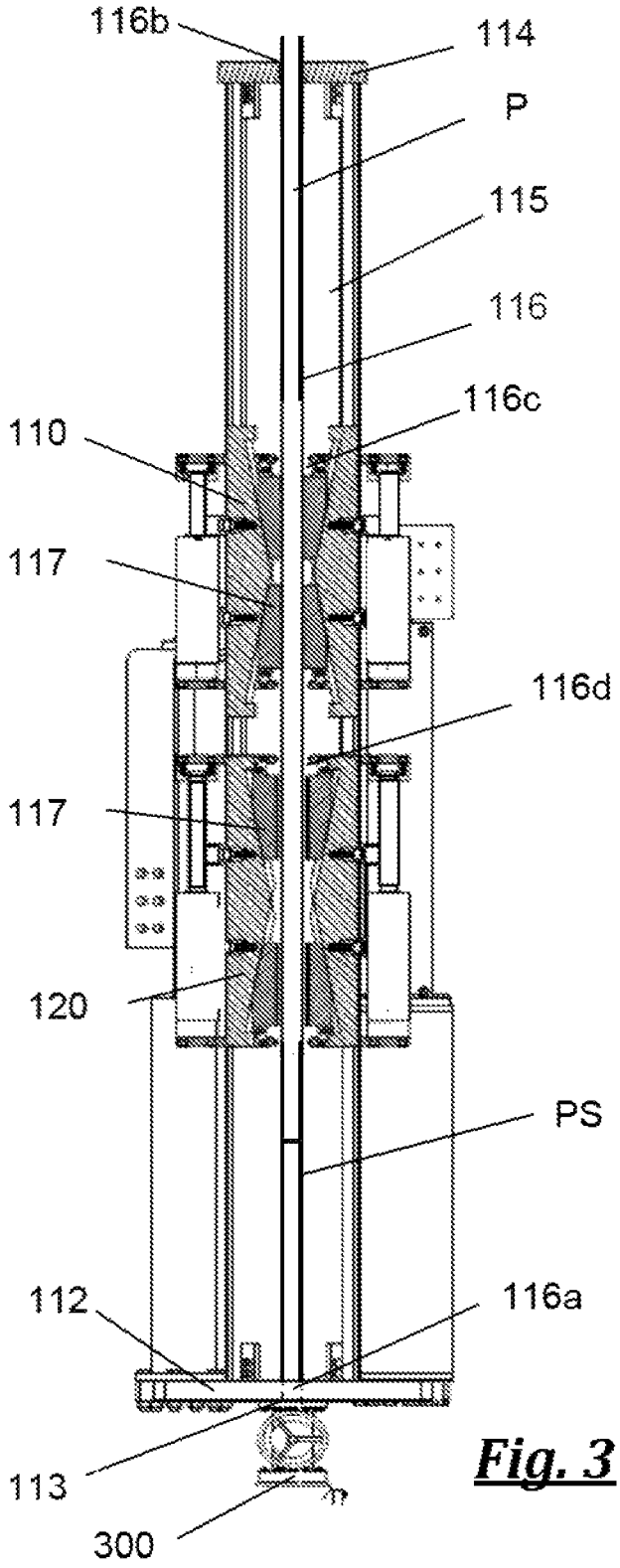
FIG. 3 is a cross-section side view of the duplex snubbing jack shown in FIG. 1 with the upper and lower gripping units in their inmost position.

FIGS. 1 through 3 show an embodiment of the duplex snubbing jack (100). As shown, the duplex snubbing jack (100) has a first or upper pipe gripping unit (110) and a second or lower pipe gripping unit (120). The pipe gripping units (110) and (120) are shown as similarly configured slip-type pipe gripping units but other types of pipe gripping units or assemblies might also be utilized. The pipe gripping units (110) and (120) are positioned between a base to (112), which may be a base plate as shown or a framework of structure members such as beams and plates, and a cap (114), shown as a plate but which may also be a framework of structure members such as beams and plates, that are separated by a plurality of support rails (115).

The support rails (115) are positioned around a central opening (116) that extends through the duplex snubbing jack (100). The central opening (116) of the duplex snubbing jack (100) includes base opening (116*a*) in the base (112), cap opening (116*b*) in the cap (114), gripping unit opening (116*c*) through the first pipe gripping unit (110), and gripping unit opening (116*d*) through the second pipe gripping unit (120) which are all in co-axial alignment with each other. The base (112) has an attachment flange (113), or an attachment flange-hole configuration, around base central opening (116*a*) that allows the duplex snubbing jack (100) to be positioned in co-axial alignment onto or adjacent to a BOP stack (300) or other wellhead device through which pipe may be inserted into a wellbore. The central opening (116) allows pipe to be extended the entire length of the duplex snubber (100) along the rails (115) though the central opening (116*a*) of the base (112) and the central opening (116*b*) of the cap (114).

As shown in FIGS. 1-3 the first pipe gripping unit (110) and the second pipe gripping unit (120) each have a pipe gripping mechanism (117) whereby a length of pipe (P) may be selectively gipped or released. As shown, pipe gripping mechanism (117) may be opened to release a length of pipe (P) or closed to grip a length of pipe (P) within their respective central openings (116*c*) and (116*d*) whereby a length of pipe (P) may be gripped or released as desired.

Figure 4:
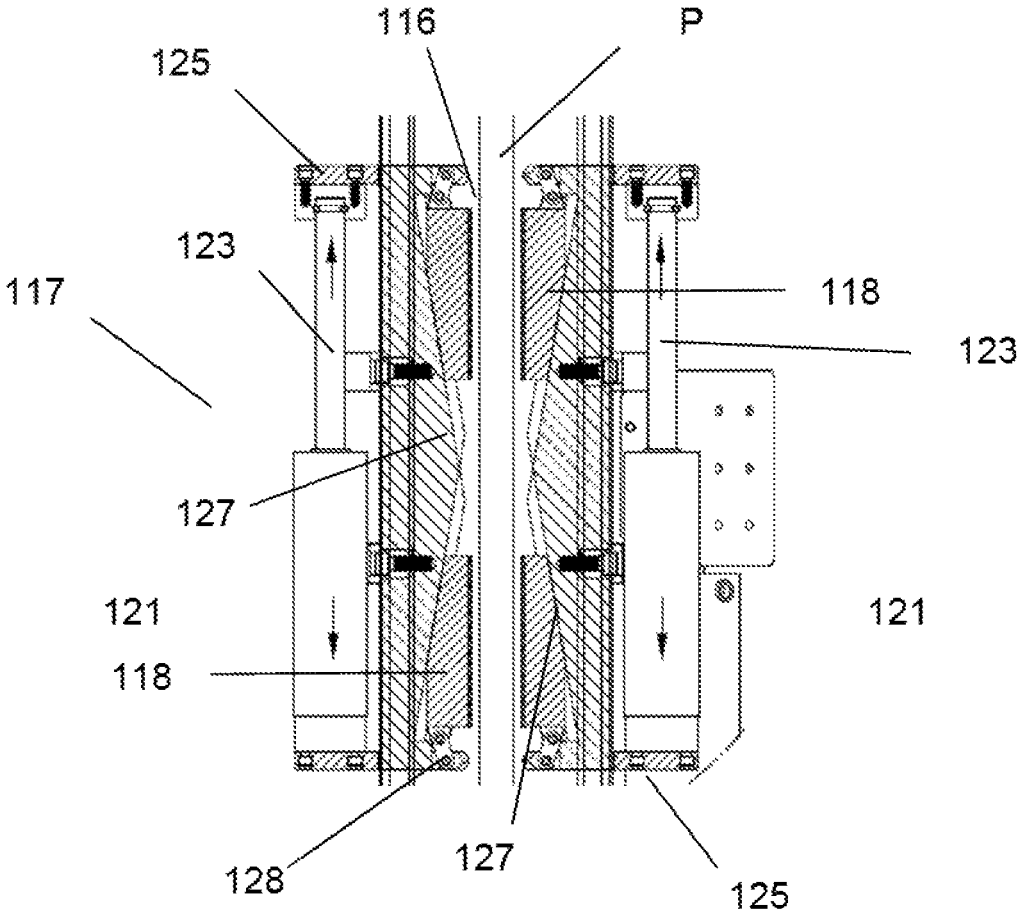
FIG. 4 is a detail cross-section side view of a pipe gripping mechanism of a gripping unit.

Gripping mechanism (117) with a slip-type pipe gripping mechanism is shown in detail in FIG. 4. The slip-type pipe gripping mechanism includes a plurality of gripping slips (118) that may be moved radially inward (closed) and outward (opened) whereby a length of pipe (P) may be gripped or released as desired. As shown, the pipe gripping slips (118) are moved by manipulation of extendable and retractable piston rods (123) of hydraulic or pneumatic cylinders (121) mounted between upper and lower timing rings (125) which are pivotally attached by links (128) to the pipe gripping slips (118) that are slidably mounted on inwardly tapered slip supports (127). Extension of the piston rods (123) will move the pipe gripping slips (118) radially outward or open with respect to central openings (116*c*) or (116*d*) as the pipe gripping slips (118) slide along the slip supports (127). Retraction of the piston rods (123) will move the pipe gripping slips (118) radially inward or closed with respect to central openings (116*c*) or (116*d*) as the pipe gripping slips (118) slide along the slip supports (127). Similar slip-type pipe gripping mechanisms are described in Applicant's U.S. Pat. No. 7,775,270 entitled *Spider With Distributed Gripping Dies* and in Applicant's U.S. Pat. No. 7,267,168 entitled *Spider With Discrete Die Supports.*

To move the first and second pipe gripping units (110) and (120), a first gripping unit positioning linear actuator (130) having a jack rod (131), or a plurality of such first gripping unit positioning linear actuators (130), is mounted on the base (112) with jack rod (131) attached to the first pipe gripping unit (110). A second gripping unit positioning linear actuator (132) having a jack rod (133), or a plurality of such second gripping unit linear actuators (132), is mounted on the base (112) with jack rod (133) attached to the second pipe gripping unit (120). A suitable positioning linear actuator (130), (132) may be a hydraulic or pneumatic cylinder having an extendable and retractable piston rod or jack rod, a rack and pinion mechanism with a motor for extending and retracting a jack rod or jack plate, or a screw jack and motor mechanism for extending and retracting a jack rod.

In operation, the base (112) of the duplex snubbing jack (100) will be mounted above the BOP stack (300) by mean of attachment flange (113) so that the central opening (116) of the duplex snubbing jack is aligned with the central opening of the BOP stack (300). The first pipe gripping unit (110) and the second ripping unit (112) are then situated at their outmost positions with respect to each other by extension of the jack rod (131) of the first gripping unit positioning linear actuator (110) and by retraction of the jack rod (133) of the second pipe gripping unit linear actuator (120) as shown in FIGS. 1 and 2. When situated at their outmost position, the second pipe gripping unit (120) is at its lowest position with respect to the BOP stack and the first pipe gripping unit (110) is at its extreme upward position away from the second pipe gripping unit (120) and BOP stack (300).

Retraction of the jack rod (131) of the first gripping unit positioning linear actuator (130) and extension of the jack rod (131) of the second pipe gripping unit linear actuator (133) will synchronously move the first pipe gripping unit (110) and the second pipe gripping unit (120) to their inmost position with respect to each other as shown in FIG. 3. When situated at such inmost position, the second pipe gripping unit (120) will have moved upwardly along the guide rails (115) to its upmost position just below the horizontal mid-line of the duplex snubbing jack (100) and the first pipe gripping unit (110) will have moved downwardly along the guide rails (115) to its lowest position just above the horizontal mid-line of the duplex snubbing jack (100). In a normal operating sequence of the duplex snubbing jack (100), the first pipe gripping unit (110) and second gripping unit (120) will always move synchronously toward or away from each other, never independently.

When attaching a pipe (P) to a wellbore pipe string (PS) and running the running pipe (P) through the BOP stack (300) into a wellbore, the pipe (P) is positioned through the central opening (116) of the duplex snubbing jack (100). The first pipe gripping unit (110) and the second unit (120) are synchronously moved to their outmost position away from each other by extension of the jack rod (131) of the first gripping unit positioning linear actuator (130) and by retraction of the jack rod (133) of the second pipe gripping unit positioning linear actuator (132).

The pipe gripping slips (118) of the lower second gripping unit (120) are then closed by moving the pipe gripping slips (118) radially inward in the central opening (116*d*) of the second pipe gripping unit (120) to grip the wellbore pipe string (PS) while the pipe gripping slips (118) of the upper gripping unit (120) are synchronously opened by moving the pipe gripping slips (118) of the first pipe gripping unit (110) radially outward in the central opening (116*c*) of the first pipe gripping unit (110) to allow a length of pipe (P) to be inserted through the central opening (116) of the duplex snubbing jack (100) where it may be attached to the wellbore pipe string (PS).

When the length of pipe (P) is attached to the wellbore pipe string (PS), the pipe gripping slips (118) of the first pipe gripping unit (110) are closed by moving the pipe gripping slips (118) of the first pipe gripping unit (110) radially inward in the central opening (116*c*) of the first gripping unit to grip the length of pipe (P) now attached to the wellbore pipe string (PS) while the gripping slips of the second pipe gripping unit (120) are synchronously opened by moving the pipe gripping slips (118) of the second pipe gripping unit radially outward in the central opening (116*d*) of the second pipe gripping unit (120) to release the wellbore pipe string (PS).

The first pipe gripping unit (110) and the second pipe gripping unit (120) are then synchronously moved downwardly and upwardly, respectively, to their inmost position toward each other by retraction of the jack rod (131) of the first gripping unit positioning linear actuator (130) and extension of the jack rod (133) of the second gripping unit positioning linear actuator (132). The downward movement of the first pipe gripping unit (110) toward its inmost position will then run the length of pipe (P) attached to the wellbore pipe string (PS) through the central opening (116*d*) of the second pipe gripping unit (120) and snub the length of pipe (P) through the BOP stack (300) and into the wellbore.

The pipe gripping slips (118) of the second pipe gripping unit (120) are then closed as previously described to grip the length of pipe (P) and then attached wellbore pipe string (PS) while the gripping slips of the first pipe gripping unit (110) are synchronously opened as previously described to release the length of pipe (P) and the attached wellbore pipe string (PS). The first pipe gripping unit (110) and the second pipe gripping unit (120) are then synchronously moved upwardly and downwardly, respectively, to their outmost position away from each other by extension of the jack rod (131) of the first positioning linear actuator (130) and retraction of the jack rod (133) of the second positioning linear actuator (132). The downward movement of the second pipe gripping unit (120) will further push the length of pipe (P) and the attached wellbore pipe string (PS) into the wellbore. This process may then be repeated to snub or run additional lengths of pipe into the wellbore.

The guide rails (115) of the duplex snubbing jack (100) support the length of pipe (P) being snubbed into the wellbore along its entire length. The lateral support of pipe (P) being snubbed provided by the guide rails will reduce the incidence of pipe buckling as the length of pipe is pushed through the BOP stack by the reciprocal movement of the gripping units.

When pulling pipe (P) from a wellbore through BOP stack (300), the duplex snubbing jack (100) is mounted above the BOP stack around the axis of a wellbore pipe string as described above for running pipe. The first or upper gripping unit (110) and the second or lower gripping unit (120) are synchronously moved to their outmost position away from each other by extension of the jack rod (131) of the first positioning linear actuator (130) and retraction of the jack rod (133) of the second positioning linear actuator (132). The pipe gripping slips (118) of the second pipe gripping unit (120) are then closed by moving the pipe gripping slips (118) of the second pipe gripping unit (120) radially inward in the central opening (116*d*) of the second pipe gripping unit to grip the wellbore pipe string (PS) while the pipe gripping slips (118) of the first pipe gripping unit (110) are synchronously opened by moving the pipe gripping slips (118) of the first gripping unit radially outward in the central opening (116*c*) of the first pipe gripping unit (110) to allow the first gripping unit to be moved along the length of the pipe (P) being pulled.

The first pipe gripping unit (110) and the second pipe gripping unit (120) are then synchronously moved downwardly and upwardly, respectively, to their inmost position toward each other by retraction of the jack rod (131) of the first positioning linear actuator (130) and extension of the jack rod (133) of the second positioning linear actuator (132). The upward movement of the second pipe gripping unit (120) toward its inmost position will then pull the length pipe (P) and the attached wellbore pipe string (PS) through the BOP stack (300) from the wellbore. The pipe gripping slips (118) of the first ripping unit (110) are then closed as previously described to grip the length of pipe (P) while the gripping slips of the second or lower gripping unit are synchronously opened as previously described to release the wellbore pipe string (PS). The first pipe gripping unit (110) and the second pipe gripping unit (120) are then synchronously moved upwardly and downwardly, respectively, to their outmost position away from each other by extension of the jack rod (131) of the first positioning linear actuator (130) and retraction of the jack rod (133) of the second positioning linear actuator (132). The upward movement of the first pipe gripping unit (110) will further pull the length of pipe (P) and the attached wellbore pipe string (PS) from the wellbore through the BOP stack (300). The attached length of pipe (P) may then be removed from the wellbore pipe string (PS). This process may then be repeated to pull or remove additional lengths of pipe from the wellbore through the BOP stack (300).

Figure 5:
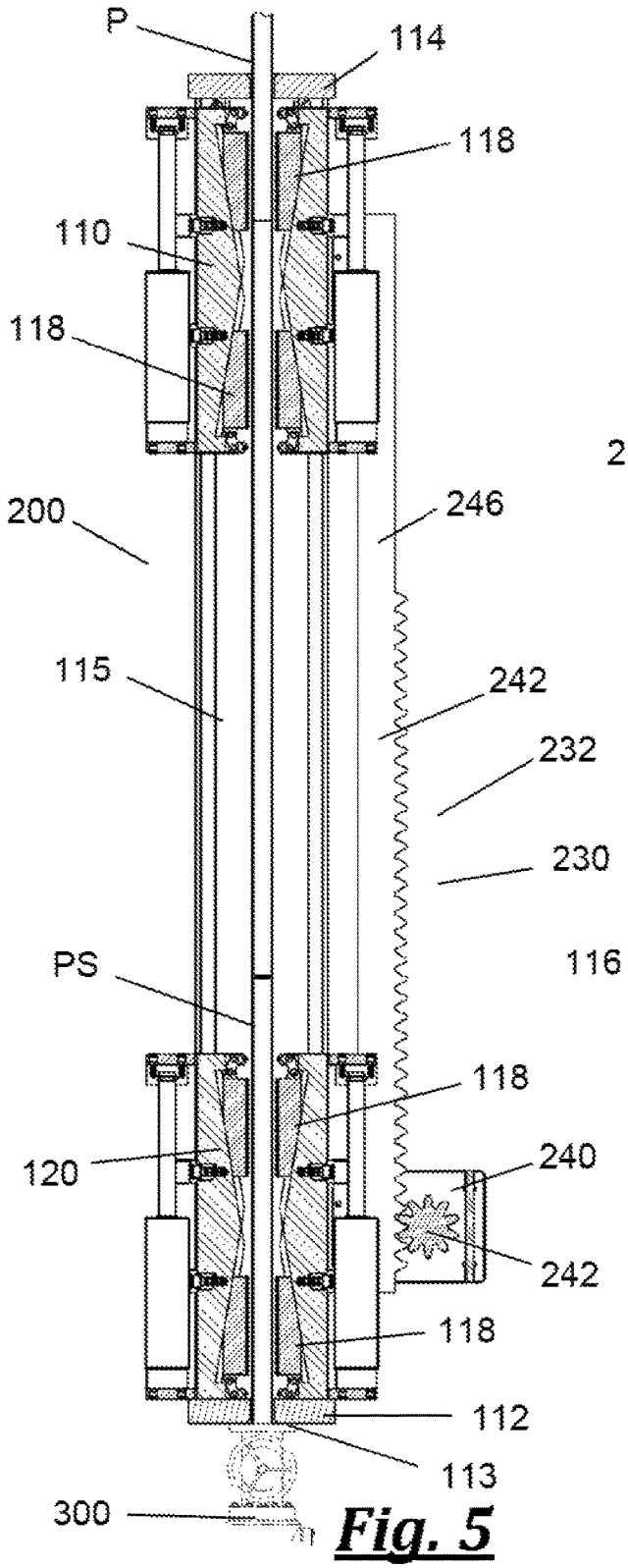
FIG. 5 is a cross-section side view of an alternate embodiment of the duplex snubbing jack with the upper gripping unit in its outmost position.
Figure 6:
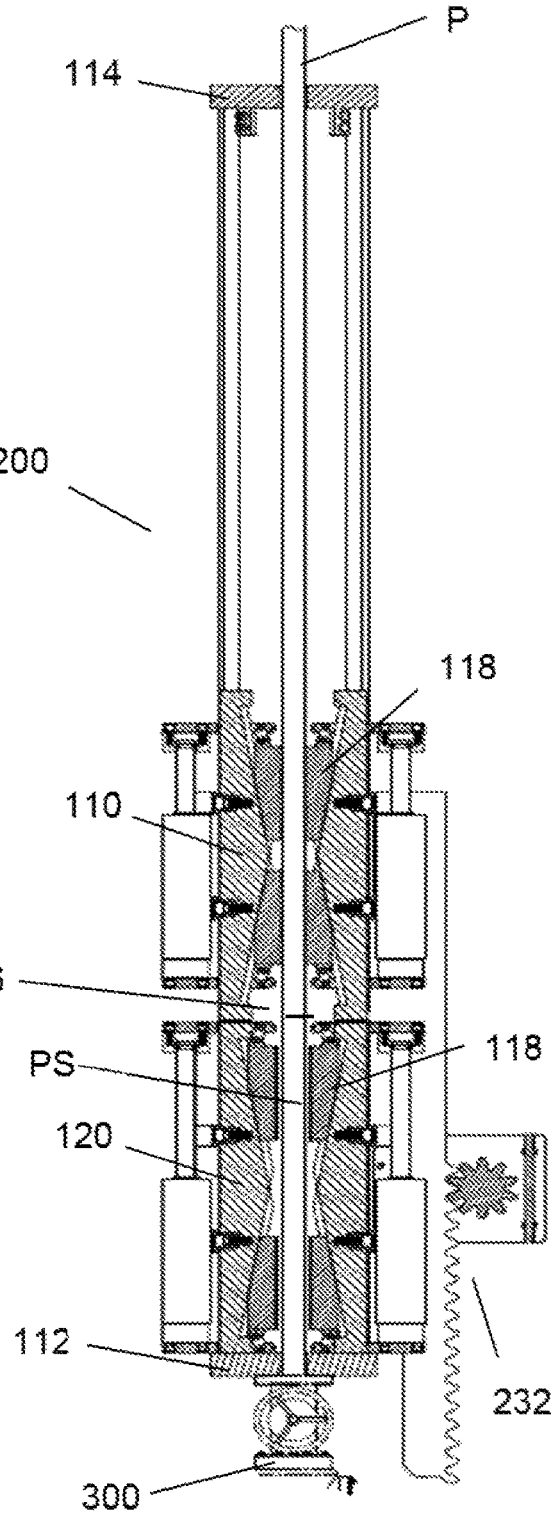
FIG. 6 is a cross-section side view of an alternate embodiment of the duplex snubbing jack shown in FIG. 5 with the upper gripping unit in its inmost position.

FIGS. 5 and 6 show a second embodiment of the duplex snubbing jack designated as duplex snubbing jack (200). In this second embodiment, snubbing jack (200) has the same first and second gripping units (110) and (120), respectively, which operate to grip and release pipe in the same manner as that shown described above for embodiment of duplex snubbing jack (100). Snubbing jack (200) also has an essentially the same base (112), cap (114), rails (115), and central opening (116) as that described above for duplex snubbing jack (100) except for perhaps for variations in size that might be necessary to accommodate attachment of an alternate to gripping unit positioning actuator (110) shown in FIGS. 1-3 and described above. Base (112) of duplex snubbing jack (200) is also configured for attachment to BOP stack (300) bye means of an attachment flange (113) at the base (112) as described for duplex snubbing jack (100).

However, for duplex Snubbing jack (200), the lower gipping unit (120) is fixed in position on the base (112) and remains stationary throughout the pipe snubbing process. The upper gripping unit (110) is moveably positioned axially along duplex snubbing jack (200), upward and downward, such as by a linear actuator (230). In this alternate embodiment, the linear actuator (230) of snubbing jack (200) is shown as a rack and pinion mechanism (232) with a motor for (240) for rotating a pinon gear (242) that engages with a gear rack (244) on a jack rod or jack plate (246) attached to the first pipe gripping unit (110). A suitable linear actuator (230) may also be a hydraulic or pneumatic cylinder having an extendable and retractable piston rod or jack rod or a screw jack and motor mechanism for extending and retracting a jack rod.

In operation of duplex snubbing jack (200), lower second gripping unit (120) stays in place and the upper first pipe gripping unit (110) is moved upward and downward with respect to gripping unit (120) and BOP stack (300). As shown in FIG. 5, first pipe gripping unit (110) may be moved to its extreme upward position away from gripping unit (120) and BOP stack (300) by rotating pinon gear (242) to engage with a gear rack (244) on a jack rod or jack plate (246) to move the attached first pipe gripping unit (110) upward to its extreme upward position with respect to first gipping unit (120) and BOP stack (300). Rotating pinon gear (242) in the opposite direction will engage gear rack (244 on a jack rod or jack plate (246) to move upper gripping unit (110) downward from its extreme upward position to its extreme lowest position just above the lower second gripping unit (120) as shown in FIG. 6. In its normal operating sequence, the first pipe griping unit (110) will always move toward or away from second gripping unit (120) and second gripping unit (120) never moves.

When pulling a length of pipe (P) attached to a wellbore pipe string (PS) from a wellbore through BOP stack (300), the pipe gripping slips (118) of the second pipe gripping unit (120) are closed by moving the pipe gripping slips (118) of the second pipe gripping unit (120) radially inward to grip the wellbore pipe string (PS) while the pipe gripping slips (118) of the first pipe gripping unit (110) are synchronously opened by moving the pipe gripping slips (118) of the first pipe gripping unit (110) radially outward to release the pipe (P) of the attached wellbore pipe string (PS) and the upper gripping unit (110) moves downwardly along the length of the pipe (P) of the attached wellbore pipe string (PS).

When the first pipe gripping unit (110) reaches its terminal downward position just above the second pipe gripping unit (120), the pipe gripping slips (118) of the first pipe gripping unit (110) are closed by moving the pipe gripping slips (118) of the first pipe gripping unit (110) radially inward to grip the length of the pipe (P) of the attached wellbore pipe string (PS) and the pipe gripping slips (118) of the second pipe gripping unit (120) are synchronously opened by moving the pipe gripping slips (118) of the second pipe gripping unit (120) radially outward to release the pipe (P) of the attached wellbore pipe string (PS). The first pipe gripping unit (110) then moves upward toward its extreme upward position with respect to the second pipe gripping unit (120) and the BOP stack (300); pulling the length of the pipe (P) and the attached wellbore pipe string (PS) from the wellbore through the BOP stack (300).

The method for pulling a length of pipe (P) attached to a wellbore pipe suing (PS) from a wellbore through BOP stack (300) described above for use of duplex snubbing jack (200) may be repeated to pull or remove additional lengths of pipe (P) from the wellbore through the BOP stack (300). The method may also be reversed for attaching a length of pipe (P) to a wellbore pipe string (PS) and snubbing or running the attached length of (P) into the wellbore through the BOP stack (300).

As noted above for the first embodiment of duplex snubber (100), the rails (115) of the duplex snubbing jack (200) are positioned around central opening (116) of the duplex snubbing jack (200) and adjacent the length of the pipe (P) of the attached wellbore pipe suing (PS) to support the length of pipe (P) when it is being run into or pulled from the wellbore through the BOP stack (300).

Among the advantages of the duplex snubbing jacks (100) and (200) is faster operation over conventional snubbing units because longer lengths of pipe (P) may be snubbed due to the support provided by the guide rails (150). This also results in gripping, releasing, and re-gripping of the pipe gripping slips (118) of the pipe gripping units (110) and (120) and less wear or on their gripping faces.

I claim:

1. A snubbing jack comprising:

(a) a base, said base mountable above a BOP stack that is in axial alignment with a wellbore, said base having a central opening in axial alignment with said BOP stack and said wellbore;

(b) a cap positioned above said base, said cap having a central opening in axial alignment with said central opening of said base;

(c) guide rails extending between said base and said cap, said guide rails positioned around said central opening of said base and said central opening of said cap whereby a pipe positioned axially through said central opening of said base and said central opening of said cap is laterally supported by said guide rails;

(d) a first pipe gripping unit, said first pipe gripping unit having a central opening in axial alignment with said central opening of said base and said central opening of said cap, said first pipe gripping unit slidably positionable along said guide rails toward and away from said base, said first pipe gripping unit having a pipe gripping mechanism whereby a pipe may be selectively gripped or released;

(e) a second pipe gripping unit positioned below first pipe gripping unit, said second pipe gripping unit having a central opening in axial alignment with said central opening of said first pipe gripping unit, said second gripping unit having a pipe gripping mechanism whereby a pipe may be selectively gripped or released; and (f) a first linear actuator attached to said base and said first pipe gripping unit whereby said first pipe gripping unit may be moved linearly downward and upward along said guide rails toward and away from said second pipe gripping unit.

2. The snubbing jack as recited in claim 1, wherein said first linear actuator includes a rack and pinion mechanism whereby a jack rod is extended.

3. The snubbing jack as recited in claim 2, further comprising a second linear actuator attached to said base and said second pipe gripping unit whereby said second pipe gripping unit may be moved linearly upward and downward along said guide rails toward and away from said second pipe gripping unit.

4. The snubbing jack as recited in claim 3, wherein said first pipe gripping unit and said second pipe gripping unit has a slip pipe gripping mechanism.

5. The snubbing jack as recited in claim 4, wherein said first and second gripping units include a plurality of slidably positionable slips pivotally attached to a timing ring wherein said slidably positionable slips move radially inward and outward in response to retraction and extension of a piston rod attached to said timing ring.

6. The snubbing jack as recited in claim 1, wherein said first linear actuator is a hydraulic cylinder with an extendable and retractable piston rod.

7. The snubbing jack as recited in claim 6, further comprising a second linear actuator attached to said base and said second pipe gripping unit whereby said second pipe gripping unit may be moved linearly upward and downward along said guide rails toward and away from said first pipe gripping unit.

8. The snubbing jack as recited in claim 7, wherein said first pipe gripping unit and said second pipe gripping unit has a slip pipe gripping mechanism.

9. The snubbing jack as recited in claim 8, wherein said first and second gripping units include a plurality of slidably positionable slips pivotally attached to a timing ring wherein said slidably positionable slips move radially inward and outward in response to retraction and extension of a piston rod attached to said timing ring.

10. A snubbing jack comprising:

(a) a base, said based mounted above a BOP stack that is in axial alignment with a wellbore, said base having a central opening in axial alignment with said BOP stack and said wellbore;

(b) a cap positioned above said base, said cap having a central opening in axial alignment with said central opening of said base;

(c) guide rails extending between said base and said cap, said guide rails positioned around said central opening of said base and said central opening of said cap;

(d) a first pipe gripping unit, said first pipe gripping unit having a central opening in axial alignment with said central opening of said base and said central opening of said cap, said first pipe gripping unit slidably positionable along said guide rails toward and away from said base, said first pipe gripping unit having a pipe gripping mechanism whereby a pipe may be selectively gripped or released;

(e) a second pipe gripping unit positioned below first pipe gripping unit, said second pipe gripping unit having a central opening in axial alignment with said central opening of said first pipe gripping unit, said second gripping unit having a pipe gripping mechanism whereby a pipe may be selectively gripped or released;

(f) a first linear actuator attached to said base and said first pipe gripping unit whereby said first pipe gripping unit may be moved linearly downward and upward along said guide rails toward and away from said second pipe gripping unit; and (g) a second linear actuator attached to said base and said second pipe gripping unit whereby said second pipe gripping unit may be moved linearly upward and downward along said guide rails toward and away from said first pipe gripping unit.

11. The snubbing jack as recited in claim 10, wherein a pipe extending axially through said central opening of said first pipe gripping unit and said central opening of said second pipe gripping unit is laterally supported by said guide rails.

12. The snubbing jack as recited in claim 11, wherein said first and said second pipe gripping units each include a plurality of slidably positionable gripping slips pivotally attached to a timing ring wherein said slidably positionable gripping slips move radially inward and outward in response to retraction and extension of a piston rod attached to said timing ring.

13. The snubbing jack as recited in claim 12, wherein said first linear actuator and said second linear actuator includes a rack and pinon mechanism whereby a jack rod is extended.

14. The snubbing jack as recited in claim 12, wherein said first linear actuator and said second linear actuator is a hydraulic cylinder with an extendable and retractable piston rod.

15. A method of snubbing a length of pipe into a wellbore through a BOP stack comprising the steps of:

(a) providing a snubbing unit having a central opening, said snubbing unit having a first pipe gripping unit, said first pipe gripping unit having central opening in axial alignment with said central opening of said snubbing unit and a pipe gripping mechanism whereby a pipe may be selectively gripped or released by opening and closing said pipe gripping mechanism, a second pipe gripping unit positioned below first pipe gripping unit, said second gripping unit having central opening in axial alignment with said central opening of said snubbing unit and a pipe gripping mechanism whereby a pipe may be selectively gripped or released by opening and closing said pipe gripping mechanism, and guide rails positioned around said central opening of said first pipe gripping unit and said central opening of said second pipe gripping whereby said first pipe gripping unit and said second pipe gripping unit may be slidably positioned upward and downward along said guide rails;

(b) mounting said snubbing unit above a BOP stack positioned in axial alignment with a pipe string positioned in a wellbore wherein said central opening of said snubbing unit and said central openings of said first and said second pipe gripping units are in axial alignment with BOP stack and said pipe string and wherein said first gripping unit is positioned above said second gripping unit;

(c) moving said first and said second pipe gripping units away from each other along said guide rails;

(d) closing said pipe gripping mechanism of said second pipe gripping unit thereby gripping said pipe string with said second gripping unit while opening said gripping mechanism of said first pipe gripping unit;

(e) positioning a pipe through said central opening of said snubbing jack whereby said pipe is laterally supported by said guiderails;

(f) attaching said pipe to said pipe string;

(g) closing said pipe gripping mechanism of said first pipe gripping unit thereby gripping said pipe attached to said pipe string with said first gripping unit while synchronously opening said gripping mechanism of said second pipe gripping unit; and (h) moving said second pipe gripping unit upward along said guide rails toward said first pipe gripping unit while synchronously moving said first pipe gripping unit downward along said guide rails toward said second pipe gripping unit and said BOP stack and thereby pushing said pipe attached to said pipe string through said BOP stack into said wellbore.

16. The method of snubbing a length of pipe into a wellbore through a BOP stack of claim 15, comprising the additional steps of:

(a) closing said pipe gripping mechanism of said second pipe gripping unit thereby gripping said pipe attached to said pipe string with said second gripping unit while opening said gripping mechanism of said first pipe gripping unit to release said pipe attached to said pipe string; and (b) moving said first pipe gripping unit upward away from said second pipe gripping unit while synchronously moving said second pipe gripping unit downward along said guide rails toward said BOP stack and thereby pushing said pipe attached to said pipe string through said BOP stack into said wellbore.

17. The method of snubbing a length of pipe into a wellbore through a BOP stack recited in claim 16 wherein said first pipe gripping unit is operative connected to a first linear actuator and said second pipe gripping unit is operatively connected to a second linear actuator, and the first and second gripping units are moved toward and away from each other by operation of the first linear actuator, operation of the second linear actuator, or operation of a combination of the first and second linear actuators.

18. The method of snubbing a length of pipe into a wellbore through a BOP stack recited in claim 17 wherein said linear actuator is a hydraulic cylinder with an extendable and retractable piston rod.

19. The method of snubbing a length of pipe into a wellbore through a BOP stack recited in claim 17 wherein said linear actuator includes a rack and pinon mechanism.

20. The method of snubbing a length of pipe into a wellbore through a BOP stack recited in claim 19 wherein said first pipe gripping unit and said second pipe gripping unit has a slip pipe gripping mechanism.

* * * * *